US008083860B2

(12) United States Patent
Loftis

(10) Patent No.: US 8,083,860 B2
(45) Date of Patent: Dec. 27, 2011

(54) CAPTURE AND REMOVAL CLEANING SYSTEM

(75) Inventor: Tony Loftis, Oakland, TN (US)

(73) Assignee: The ServiceMaster Company, Memphis, TN (US)

( * ) Notice: Subject to any disclaimer, the term of this patent is extended or adjusted under 35 U.S.C. 154(b) by 1008 days.

(21) Appl. No.: 11/945,645

(22) Filed: Nov. 27, 2007

(65) Prior Publication Data

US 2009/0133203 A1 May 28, 2009

(51) Int. Cl.
*B08B 7/04* (2006.01)
*B08B 5/04* (2006.01)
*A46B 9/02* (2006.01)

(52) U.S. Cl. ..... 134/6; 134/21; 15/159.1; 15/207.2

(58) Field of Classification Search ..... 134/6, 21; 15/159.1, 207.2
See application file for complete search history.

(56) References Cited

U.S. PATENT DOCUMENTS

| | | | | |
|---|---|---|---|---|
| 2,198,339 | A | 4/1940 | Hamilton | |
| 4,552,692 | A * | 11/1985 | Gillespie | 510/280 |
| 4,938,309 | A * | 7/1990 | Emdy | 181/231 |
| 5,074,008 | A | 12/1991 | Palomino, Jr. | |
| 5,147,467 | A | 9/1992 | Virtue | |
| 6,370,731 | B1 | 4/2002 | Carter | |
| 6,530,106 | B1 | 3/2003 | Brundula | |
| 6,960,042 | B1 * | 11/2005 | Hsiao | 401/138 |
| 6,964,081 | B1 | 11/2005 | Clement et al. | |
| 2005/0071949 | A1 * | 4/2005 | Martinez et al. | 16/30 |
| 2006/0026750 | A1 | 2/2006 | Ballance | |
| 2007/0172340 | A1 | 7/2007 | Curotto et al. | |
| 2007/0187263 | A1 | 8/2007 | Field et al. | |

OTHER PUBLICATIONS

NSCB—Technical Checklist for Janitorial Services; www.nscb.gov.ph; Posted Online Nov. 21, 2005.*

* cited by examiner

*Primary Examiner* — Michael Kornakov
*Assistant Examiner* — Natasha Campbell
(74) *Attorney, Agent, or Firm* — Baker & Hostetler LLP

(57) ABSTRACT

Example embodiments of the invention include a cleaning system having both daily cleaning tasks and periodic cleaning tasks for cleaning and dusting a room. By utilizing less inventory and more biocompatible, "bio-safe" products than traditional systems, embodiments of the cleaning system requires less tools yet, allows its users to combine cleaning processes in a time-saving feature. The invention further includes the use of an inventive cleaning brush apparatus for which allows dirt and dust to be swept into gaps between rows of bristles, which are attached to a handle via metal rails. Accordingly, dust is concurrently collected into a row of suction holes without requiring separate steps to sweep and collect the dust. As such, the spacing of the inner and outer bristles allows for dust to be trapped in the gaps rather than permanently dispersing into the breathing air.

21 Claims, 4 Drawing Sheets

CAPTURE AND REMOVAL CLEANING SYSTEM

FIELD OF THE INVENTION

The present invention relates generally to a capture and removal cleaning system. More particularly, the present invention relates to a system that combines low environmental impact cleaning using sustainable cleaning products and systems.

BACKGROUND OF THE INVENTION

Dirt, which is waste material that is an unwanted or undesired mixture of dust, soil, and other solids, frequently accumulates on surfaces, such as on floors or carpets, in offices, homes and other human environments. Dust often attracts dust mites, which flourish in the fibers of bedding, furniture, and carpets. Enzymes used by the dust mites to digest dust particles and their feces, become part of house dust and can provoke allergic reactions in humans. In fact, dust mites are considered to be the most common cause of asthma and allergic symptoms worldwide.

For aesthetic and health-related reasons, a myriad of cleaning systems for removing dirt have been developed. These traditional cleaning systems focus on complex cleaning using individual application products. These products typically include several spray bottles, squeeze bottles, cleaning cloths, dust mops, wet mops, bowl mops and holders, and buckets and wringers. Traditional cleaning processes may include wiping, swiping, or sweeping by hand, or with a dust cloth, sponge, duster, or broom, or by suction by a vacuum cleaner or air filter. One such process includes the use of a bristled brush which is used to sweep dirt to a location to be later collected using some appropriate device such as a dustpan. A major disadvantage of these previous systems of cleaning is that often, dirt must first be swept to a desired location and then separately, utilizing an additional cleaning step and/or device to remove the dirt. As such, traditional cleaning systems often require multiple steps and tools to accomplish each cleaning task and also result in several user manuals and teaching videos to enable safe and efficient use of the cleaning system.

Furthermore, because dust and other debris that frequently accumulate in offices, homes and other human environments can easily become airborne, care must be exercised when removing dust, as the activity intended to sanitize or remove dust may easily make it airborne. Previous devices and methods of removing dust are often inefficient because while attempting to trap up the dust particles, dust particles frequently become airborne and resettle onto surfaces in the environment. Additionally, the activity can be somewhat hazardous because dust particles may come to settle in the cleaner's lungs. Preventing the inhalation of dust particles is especially critical for individuals having asthma and/or allergies.

Accordingly, it is desirable to provide a cleaning system for improved cleaning requiring fewer tools and utilizing multitasking process steps. It is also desirable to develop a system for trapping and collecting dirt in a central location while impeding the dispersion of dust particles into the air. It is also desirable to develop a cleaning system that is easier to use and simpler to train to cleaning personnel.

SUMMARY OF THE INVENTION

The foregoing needs are met, to a great extent, by the present invention, wherein in one aspect a cleaning system is designed especially to provide improved cleaning while simplifying training of cleaning personnel, improving cleaning product safety, decreasing cleaning inventory and improving indoor air quality. Additionally, the cleaning system is provided that in some embodiments include a cleaning brush apparatus that safely gathers dust particles within gaps between its rows of bristles.

A cleaning system for dusting and cleaning includes daily and periodic cleaning tasks. The daily tasks include: collecting and emptying trash into a vehicle for collecting trash, wherein the vehicle includes a container attached to a caster dolly; spot dusting using a cleaning brush apparatus attached to a vacuum; spot cleaning surfaces using a microfiber cloth and a bio-safe general purpose cleaner; spot cleaning the floors; and inspecting of the room to ensure the desired level of cleanliness and to make sure that all tools and equipment and chairs have been returned to the appropriate location. The periodic cleaning tasks include: dusting high and low dusting areas using the cleaning brush apparatus; damp wiping all surfaces of the room using the microfiber cloth and the bio-safe general purpose cleaner; and complete cleaning of the floors. For instance, periodic tasks may be performed weekly.

In example embodiments, the cleaning brush apparatus used in conjunction with the inventive cleaning system comprises: a handle having a first end and a second end; an outer rail of bristles along an outer portion of the brush having a first row of outer bristles and a second row of outer bristles; an inner rail of bristles along an inner portion of the brush having a first row of inner bristles and a second row of inner bristles; at least one row of suction holes located between the first row of outer bristles and the second row of outer bristles to remove materials trapped within the brush; and a front row of bristles located along the second end of the handle. The cleaning brush apparatus may further include a third row of inner bristles. Furthermore, the outer and inner rails of bristles of the cleaning brush apparatus may be configured to make dirt and soil airborne.

In embodiments of the cleaning brush apparatus, the at least one row of suction holes of the cleaning brush apparatus may include: a first row of suction holes located between the first row of outer bristles and the first row of inner bristles; a second row of suction holes located between the second row of outer bristles and the second row of inner bristles; and a third row of suction holes located between the first and second rows of inner bristles. The suction holes within the first, second and third rows may also be staggered in relation to each other. The front row of bristles of the cleaning brush apparatus may include bristles that angularly protrude from the handle forming an angle other than 90 degrees. The brush apparatus may also include a plurality of sloped ridges adjacent to each suction hole in the at least one row of suction holes. The suction holes of the cleaning brush apparatus that are closer to the first end of the handle may be smaller than the suction holes closer to the second end of the handle.

In example embodiments of the cleaning system for dusting and cleaning, spot cleaning the floors may include vacuuming using a vacuum that is capable of capturing 99.97% of particulates 0.3 microns with a sound decibel level of 70 or less, in accordance with standards set by Leadership in Environmental Design (LEED) Green Building Rating System® guidelines. Spot cleaning the floors may include mopping using a single step mopping system, which may have a push button fluid control valve. The push button fluid control valve may be configured to dispenses a bio-safe neutral pH floor cleanser when activated.

In example embodiments of the cleaning system, complete cleaning of the floors includes spraying a general purpose carpet cleaner and stain remover, wherein the general purpose carpet cleaner and stain remover may be applied with a pressure sprayer. The general purpose carpet cleaner and stain remover may be designed for use with low moisture systems and does not require extraction. The complete cleaning of the floors may include completely vacuuming carpets and mopping floors.

In example embodiments of the invention, a cleaning system for dusting and cleaning a breakroom may include daily and periodic cleaning tasks. The daily cleaning tasks may include: pre-spraying a microwave with a bio-safe general purpose cleaner; cleaning the microwave using microfiber cloth and the bio-safe general purpose cleaner; spot cleaning surfaces using a microfiber cloth and the bio-safe general purpose cleaner; cleaning sinks using a bio-safe non-corrosive cleanser for daily cleaning of restroom fixtures; spot cleaning the floors; and inspecting of the breakroom to ensure the desired level of cleanliness and to make sure that all tools and equipment and chairs have been returned to the appropriate location. The periodic cleaning tasks may include: dusting high and low dusting areas using the cleaning brush apparatus attached to a vacuum; damp cleaning all surfaces of the room using the micro fiber cloth and the bio-safe general purpose cleaner; and complete cleaning of the floors.

In example embodiments of the invention, a cleaning system for dusting and cleaning a restroom may include daily and periodic cleaning tasks. The daily tasks may include: pre-spraying flushables and sinks with a bio-safe non-corrosive cleanser for daily cleaning of restroom fixtures; pre-spraying other surfaces with a bio-safe general purpose cleaner; restocking all restroom supplies; collecting and emptying trash into a vehicle for collecting trash, wherein the vehicle includes a container attached to a caster dolly; damp wiping upper surfaces, flushables and sinks using a microfiber cloth; spot cleaning the floors; and inspecting of the restroom to ensure the desired level of cleanliness and to make sure that all tools and equipment have been returned to the appropriate location. The periodic cleaning tasks may include: dusting high and low dusting areas using the cleaning brush apparatus attached to a vacuum; and damp wiping lower surfaces, including pipes below fixtures, using a microfiber cloth. The periodic cleaning tasks may also include complete cleaning of a shower using a brush and the bio-safe non-corrosive cleanser.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
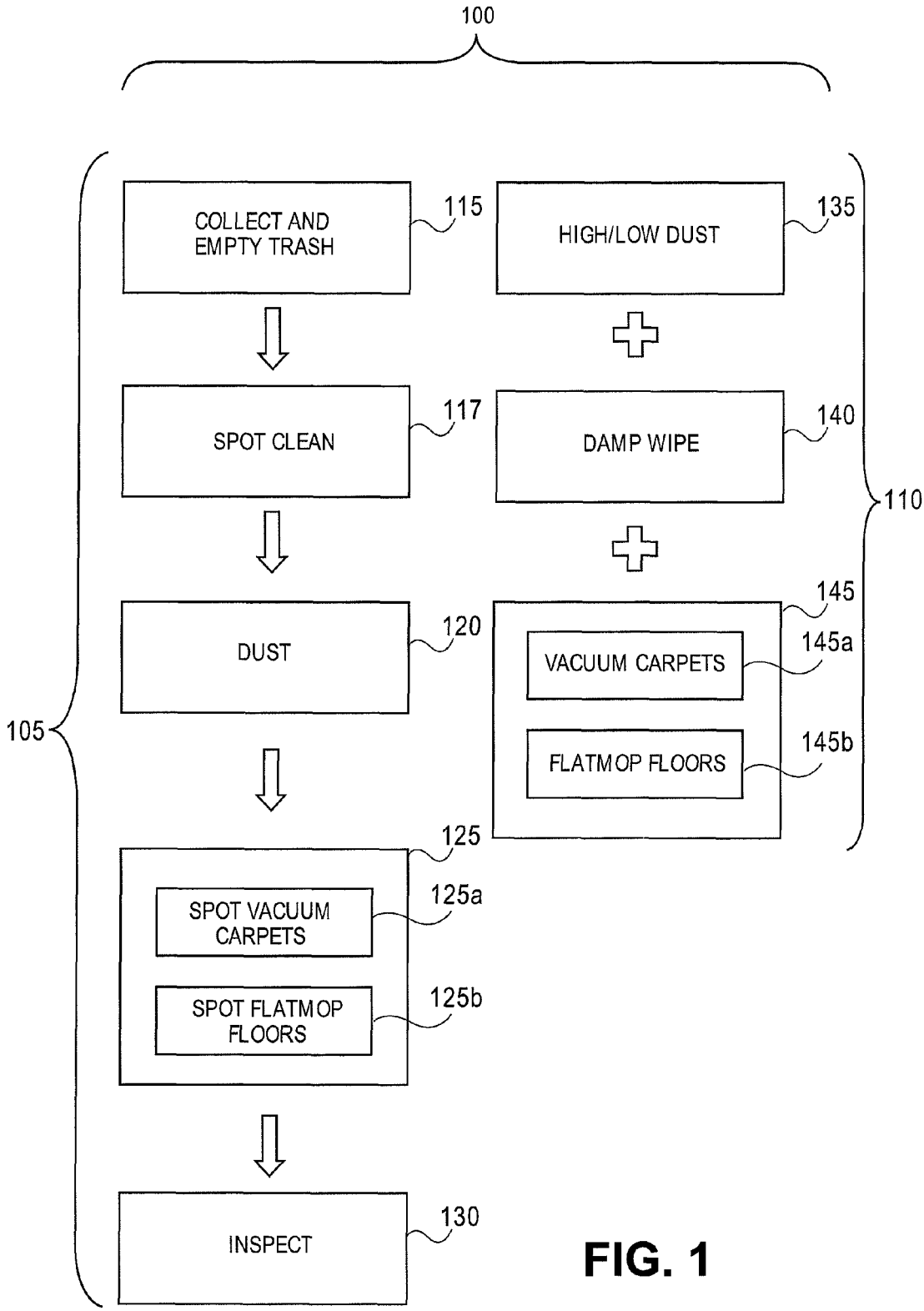
FIG. 1 is a schematic showing of a cleaning system for cleaning an office, according to an embodiment of the invention.

Example embodiments of the present invention provide a cleaning system having improved quality and improved productivity. In these embodiments, the cleaning system may utilize less inventory and more biocompatible, "bio-safe" products than traditional systems. As such, embodiments of the cleaning system includes a system that requires less tools yet, allows its users to combine cleaning processes in a time-saving feature. The system also allows for simpler training because a simplified manual and improved labels may be used rather than numerous training manuals and videos for each cleaning tool. Cleaning systems, in accordance with the invention, optimally utilize particular system-approved products, equipment and tools, as further discussed below.

In example embodiments of the invention, a cleaning brush apparatus may be used in conjunction with the cleaning system. Example embodiments of the cleaning brush apparatus allow for dirt and dust to be swept into gaps between rows of bristles, which are attached to a handle via metal rails. In these embodiments, the dust is concurrently collected into a row of suction holes without requiring separate steps to sweep and collect the dust. As such, the spacing of the inner and outer bristles allows for dust to be trapped in the gaps rather than permanently dispersing into the breathing air. Additionally, surfaces are unlikely to be damaged during dusting because protective frontal bristles prevent the handle from contacting and scratching the surfaces. The inventive cleaning system and cleaning brush apparatus will now be described with reference to the drawing figures, in which like reference numerals refer to like parts throughout.

FIG. 1 is a schematic showing of a cleaning system for cleaning an office, according to an embodiment of the invention. Example embodiments of the present invention provide a cleaning system 100 for cleaning a room, such as for cleaning an office. The cleaning system 100 separates cleaning steps into a daily routine 105 and a periodic series 110, such as weekly tasks, for cleaning a room, such as an office. The daily tasks 105 include the steps of emptying the trash 115, spot cleaning 117, spot vacuum dusting 120, spot cleaning floors 125, which includes spot vacuuming carpets **125*a* and/or spot flat-mopping floors 125*b*. Lastly, the daily tasks 105 are concluded with an inspection 130 of the room to ensure the desired level of cleanliness. The weekly tasks 110 include high and low level dusting 135, damp wipe of furniture such as desks 140 and comprehensive cleaning of floors 145**, which may include vacuuming carpets and/or flat-mopping floors.

In example embodiments of cleaning system 100 for cleaning a room, system-approved trash receptacle will be used in collecting and emptying the trash 115. For instance, a 44-gallon Brute® container with a caster dolly may be used to collect trash and debris. The Brute® container may be stored in a janitor's closet. In example embodiments, trash should be emptied into the Brute® container as the first step 115 in the cleaning system 100. In larger facilities, trash may be collected and staged for pickup later. Additionally, a tarp or hopper may be used to protect the floor from leakage, for instance a 6-foot by 6-foot tarp may be used. Strategic placement of liners may be used to facilitate fast and effective trash gathering. When torn or soiled, the liners may be replaced. If the liner needs replacing, the liner should be grasped and removed from the trash can and replaced with a new liner. The used liner may be placed in the Brute® container. The trash can should be replaced to its original location. Debris on the floor that cannot ordinarily be vacuumed should be picked up and placed into the Brute® container. If the office needs no further attention, for instance, an unused office, the light may be turned off to signal that no additional service is required with respect to the room.

In example embodiments of cleaning system 100 for cleaning a room, certain system-approved products are used to perform spot cleaning 117. Ready-to-use (RTU) bio-safe general purpose cleaner, such as Green Form General Purpose Cleaning (GPC) may be used on glass, metal, ceramic, laminate, and painted surfaces. GPC, which has a light green label identifier color, may be used to remove light to medium soil and to clean glass without streaking. GPC, or other suitable RTU general purpose cleaner, may be applied directly to surfaces or to a microfiber cloth with a dispenser or by a spray bottle with pre-diluted solution.

Microfiber technology is used in various parts of the cleaning system 100. Microfibers are synthetic fibers made of polyester and nylon, with a thickness less than one-hundredth the thickness of human hair. Micro fibers have microscopically small, sharp edges that grab hold of soil. Liquids are also drawn to the fiber by use of capillary action, but are easily released by rinsing or laundering. The use of microfiber technology in the cloths used ensure optimized spot cleaning 117 of the room.

In example embodiments of the invention, the dispenser used with the microfiber cloth may be a machine that mixes and dispenses a correctly proportioned RTU mixture and may also be referred to as a proportioner. The dispenser eliminates waste and reduces ambient exposure of concentrated product. A clear label may be placed on the dispenser to reduce the chance of product misuse. Additionally, the product dispenser may have both high flow capability for filling buckets and auto-scrubbers and low flow capacity to fill spray bottles. The product dispenser may also have a selector switch which allows the choice of dispensing one of four or more different products.

A small amount of GPC may be used, for instance, in spot cleaning 117 glass and desk surfaces in the cleaning system 100. As such, food stains, fingerprints and coffee cup rings may be removed from surfaces. In example embodiments, GPC may also be used to clean a soiled trash can. Microfiber cloth dampened with cleaner may be used to spot clean entry glass, for instance. As dirt accumulates on the cloth, the cloth may be rinsed, wrung and reused to avoid causing streaking due to excessive soil buildup. Larger or extra dampened clothes may be supplied to clean a large area to decrease the number of times the cloth is to be rinsed.

Figure 2:
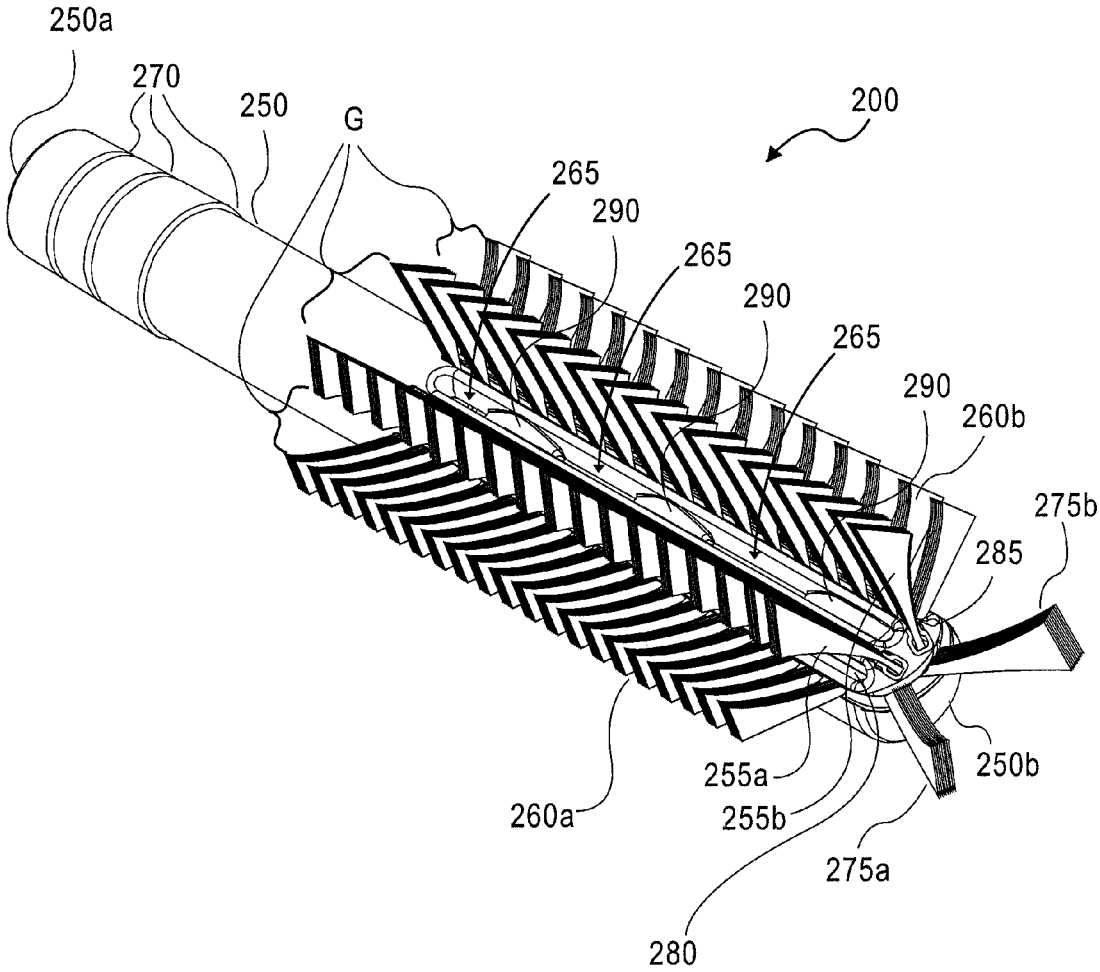
FIG. 2 is a bottom perspective view of a cleaning brush apparatus for use in the cleaning system, according to another embodiment of the invention.

In the next daily step 105 of the cleaning system 100 for cleaning a room, vacuum dusting 120 may be accomplished using a cleaning brush apparatus, such as a Dust Wand®, which sweeps and collects dust in one step. An embodiment of such a cleaning brush apparatus is illustrated in FIG. 2. The cleaning brush apparatus 200 having a handle 250 suitable for attaching the apparatus 200 to a vacuum (not shown) and rows of bristles 255*a*, 255*b*, 260*a* and 260*b*. Dirt and dust are conducted into the gaps G located between the rows of bristles 255*a*, 255*b*, 260*a* and 260*b*.

In example embodiments, the cleaning brush apparatus 200 has a row of center suction holes 265 within the gap G, located in between the inner rows of bristles 255*a* and 255*b*. In example embodiments, the rows of bristles 255*a*, 255*b*, 260*a* and 260*b* are pointed away from the row of center suction holes 265. The handle 250 can also include grooves 270 at one end of the brush apparatus 200 for aiding the mating of the apparatus 200 to a vacuum hose (not shown).

The cleaning brush apparatus 200 may also have front bristles 275*a* and 275*b*, as shown in FIG. 2. Because the frontal bristles 275*a* and 275*b* are pointed outward, the handle 250 is significantly less likely to damage surfaces as dust is removed from them. For this reason, the front bristles 275*a* and 275*b* point out forming an angle other than a 90 degree angle with respect to the handle 250. Although shown with two front bristles 275*a* and 275*b*, the brush apparatus 200 can include one or more front bristles for preventing the handle 250 from scratching surfaces during dusting. In example embodiments, for example, the cleaning brush apparatus 200 may include at least two frontal bristles 275*a* and 275*b*.

In example embodiments of the cleaning brush apparatus 200, two inner rows of bristles 255*a* and 255*b* may be attached to the handle 250. The two inner rows of bristles 255*a* and 255*b* may attach at an angle such that the bristles point away from the row of center suction holes 265. In other embodiments, the brush apparatus 200 may also include 3 or more inner rows of bristles 255*a* and 255*b*.

The outer rows of bristles 260*a* and 260*b* may be more angled than the inner rows of bristles 255*a* and 255*b* in order to maintain a wide gap G between rows of bristles 255*a* and 260*a* and between rows of bristles 255*b* and 260*b*. It is desirable to maintain an approximately one-half-inch gap G between the rows of bristles. However, gaps between ¼ inch or less and 1 inch or more are within the embodiments of the invention. In example embodiments of the cleaning brush apparatus 200, the rows of bristles 255*a*, 255*b*, 260*a* and 260*b* may include bristles made of strands of horse hair or synthetic or other suitable material.

The handle 250 of the apparatus 200 may be manufactured from wood, steel, aluminum, plastic, or a combination thereof or another material suitable for use as a vacuum hose attachment or as a stand-alone brush. A handle 250 in accordance with the present invention may be approximately 7-21 inches long. For example, the handle 250 may be 14 inches long. The handle 250 may include inner rail attachments (not shown) for attaching rows of bristles 255*a*, 255*b*, 260*a* and 260*b*. This configuration of removable rails of bristles enables selective replacement of damaged rows of bristles, which allows for cheaper maintenance of the brush apparatus 200 because only rows that need be replaced need be discarded, instead of discarding the whole brush.

The handle 250 has a row of center suction holes 265, discussed above, and also has an outer row of suction holes 280, located between inner row of bristles 255*a* and one outer row of bristles 260*a*. The handle 250 has another outer row of suction holes 285, located between inner row of bristles 255*b* and one outer row of bristles 260*b*. In example embodiments, each row of suction holes 265, 280 and 285 has three sets of suction holes of different shapes and sizes, and can include more or less sets of suction holes as needed. Additionally, the handle may have a plurality of sloped ridges 290 which are curved portions that slope inward towards the suction holes such that the dust is easily suctioned into the holes.

When the cleaning brush apparatus 200 is in use, a vacuum (not shown) is attached at a proximate end 250*a* of the handle 250. The vacuum is furthest from the distal end 250*b* of the handle 250. Accordingly, the vacuum would provide more suction power at suction holes located closest to the proximate end 250*a* of the handle 250. To account for this venturi effect, which causes a decrease in suction power for holes further away from the vacuum, within each row of suction holes, 265, 280 and 285, the suction holes that are closer to the distal end 250*a* of the handle 250 may be larger to provide better suction of dust particles. In example embodiments, the suction holes located closest to the proximate end 250*a* of the handle 250 are smallest because the suction power at that location is strongest. Thus, the suction holes increase in size as each row of holes 265, 280 and 285 approach the distal end 250*b* of the handle 250. For instance, the row of suction holes 265 may include 3 holes wherein: the hole closest to the proximate end 250*a* is 0.9 inches; the middle hole is 1 inch in length, and; the hole closest to the distal end 250*b* is 1.1 inches. In other embodiments, the suction holes in rows 265, 280 and 285 may be aligned with each other or alternatively, staggered in relation to each other.

The cleaning brush apparatus 200 may be attached to a vacuum and applied to surfaces to remove dust particles and other small debris. When in use, the ends of the bristles contact a surface to be dusted at an angle. The outer and inner rows of bristles 255*a*, 255*b*, 260*a* and 260*b* may be configured to make the particles and debris airborne by stirring up dust which then becomes trapped in the gaps G. The dust is then collected by the vacuum (not shown) via suction holes in rows 265, 280 and 285. The frontal bristles 275*a* and 275*b* protect surfaces during dusting by preventing the handle 250 from contacting surfaces at its distal end 250*a*.

In accordance with the invention, upon entering an office, vacuum dusting 120 using the cleaning brush apparatus 200 should begin by dusting to the right of the point of entry. Vacuum dusting 120 may then proceed around the room back towards the point of entry. Vacuum dusting 120 will include applying the cleaning brush apparatus 200 to ledges, molding, frames, behind the computers and out of way places. Generally, work surfaces will not be vacuum dusted 120 because they would have been dampened during spot cleaning 117 to remove fingerprints and food stains. Although vacuum dusting 117 is initially treated as a daily step 105, it is anticipated that the cleaning brush apparatus 200 would clean the environment to the point that the dusting step 117 may become a weekly step 110 rather than a daily step 105.

The next daily step 105 in the cleaning system 100 for cleaning a room is spot vacuuming 125*a* and/or spot flat-mopping 125*b* the floors. Carpet may be vacuumed 125*a* using a vacuum that is capable of capturing 99.97% of particulates 0.3 microns with a sound decibel level of 70 or less, in accordance with standards set by Leadership in Environmental Design (LEED) Green Building Rating System® guidelines. Examples of vacuum models that meet this criteria are PV-500™, Everest™, Provac™, and Alpine™ backpack vacuums, among other upright and backpack vacuum models.

The vacuums may be used in conjunction with several attachments, such as the Sidewinder Tools™, to achieve the maximum cleaning efficiency. These tools save time normally spent moving and positioning furniture to permit spot vacuuming 125*a*. Avoiding spot vacuuming 125*a* any large objects or materials, which may damage the vacuum or stop airflow, the vacuum should be applied around the room as needed. Any furniture that has been moved should then be repositioned back to its original location.

A low-moisture, spot-cleaner, such as Green For™ Carpet (GFC) may be used with the vacuum. GFC is a versatile general purpose carpet cleaner and spot remover. The cleaner is easy to use and is effective on most maintenance tasks. The RTU solution can be applied with a pressure sprayer. GFC is effective with low moisture systems and does not require extraction.

In spot flat-mopping hard floors, a single-step mopping system, such as the FlatMop™ and MegaMop™, may be used. These single step mopping systems eliminate the need for a bucket and wringer and in most cases, also serves the purpose of a presweep or dustmop. These processes have been replaced by damp mopping which provides greater productivity. The MegaMop™ is a hollow aluminum tube mop that dispenses RTU floor cleaning products. The aluminum and plastic construction of the MegaMop™ results in a clean professional appearance. Cushioned foam hand pads provide user comfort.

A squeeze bottle is used to fill the MegaMop™ with the appropriate product. Floor cleaner, such as Green For™ Floors (GFF), is applied to the floor by use of a push button fluid control valve. GFF is a neutral pH cleaner for routine cleaning of hard surface floors which removes soil and black heel marks effectively. GFF does not require rinsing and will not damage the floor finish. The RTU mixture may be applied to the floor surfaces with a squirt bottle, spray bottle by presoaking MegaPads™ or through the MegaMop™.

A microfiber flat pad, such as a MegaPad™, may be used with the MegaMop™. A velcro backing may be used to attach a MegaPad™ to the holder at the base of the mop holder. Cleaning solution is dispensed from the MegaMop™ onto the floor. The MegaPad™ is worked into the solution until damp, and then the floor is cleaned. Improved cleaning is possible, in part, because microfiber technology is used in the MegaPad™.

The MegaMop™ may be prepared for use by connecting the MegaPad™ holder with spring loaded buttons at the bottom of the pole. The flexible tube and wider side of the holder should be on the same side. Then the valve should be removed from the top of the MegaMop™ and may be filled with RTU solution and the valve should be replaced at the top of the MegaMop™. The push button fluid control valve may be activated to allow RTU solution to flow. The MegaPad™ may be worked into the solution until damp, and then cleaning of the floor may begin. The MegaMop™ may be used to spot clean 125*b* the floor. Since the FlatMop™ and bottle contain the floor cleaning solution, there is no need for a bucket and wringer. Arm and back strain from using the wringer and time wasted emptying and refilling the bucket are eliminated. Fresh, uncontaminated solution is delivered at all times. In addition to spot cleaning the floors 125*b* of the office, the floors of the breakrooms, restrooms, etc. may also be spot cleaned at the same time.

The last simple step of inspection 130 is the most often forgotten step of the cleaning system 100 and yet is the most important step. Inspection 130 consists of looking around the room for furniture out of place, trash receptacles not replaced, spray bottles left behind, etc. During this inspection 130, soiled areas missed earlier may be found at which point any of the previous steps of dusting and cleaning may be repeated. Accordingly, the room should look clean and orderly upon completion.

The periodic tasks 110 are optional tasks which may be performed on a daily basis, only if needed. The periodic tasks 110 begin with high/low dusting 135. Upon entering the room, high dust surfaces should be dusted using the cleaning brush apparatus 200. High dust surfaces may include any surface above shoulder height such as, tops of lights, doors, curtain top partitions, ventilation covers, etc. The high/low dusting 135 should proceed around high places of the room until the entryway is reached. Then, dusting should proceed lower towards low dust surfaces, which include surfaces below the waist such as, arms and legs of chairs, tables, radiators and air conditioning units, etc. Generally, such intensive dusting is only needed on a weekly basis.

The next periodic task is damp wiping 140 of desks. Upon entering the room, damp cleaning 140 may proceed to the right and proceeds around the room and back to the point of entry. Microfiber cloth may be used as with the daily task 105 for spot cleaning 117 of the desks. Additionally, GPC should be used on all surfaces. Damp cleaning 140 may be used to remove soil from cubicle partitions, file cabinets, glass, furniture, light switches, door frames and walls.

The final step of the capture and removal cleaning system 100 for an office is the step of cleaning the floors 145. This may include vacuuming the carpets 145*a* and/or flatmopping the floors 145*b*. The vacuum or flatmop may be applied working around the room until the entire floor is cleaned. When using a mop, such as the MegaMop™ or FlatMop™, the floor should be cleaned from the back of the room towards the entryway. An S-shaped stroke may be used to catch dirt and debris on the leading edge of the MegaMop™. When mopping a large area, multiple mop pads may be used. The MegaPad™ may be used and changed every 3 or 4 rooms or when soiled. The MegaPad™ may be laundered and reused. In addition to cleaning the floors 145 of the office, the floors of the breakrooms, restrooms, etc. may also be cleaned at the same time.

Figure 3:
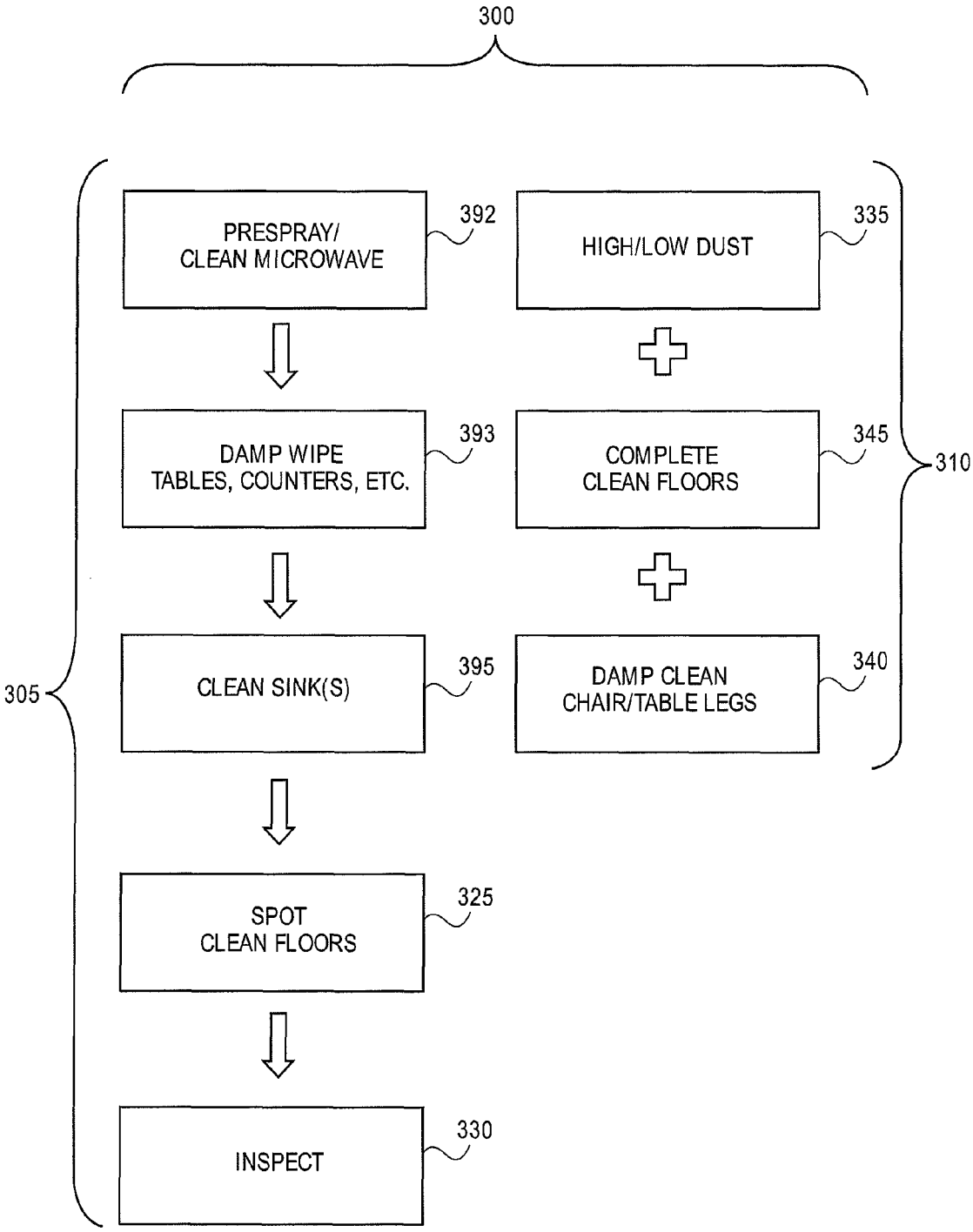
FIG. 3 is a schematic showing of a cleaning system for cleaning a break room, according to an embodiment of the invention.

FIG. 3 is a schematic showing of a cleaning system 300 for cleaning a break room, according to an embodiment of the invention. As with cleaning an office, the cleaning system 300 for cleaning a break room includes both daily tasks 305 and a periodic series 310. The first daily task 305 is cleaning the microwave 392, which may include pre-spraying with GPC. In the case of hardened food particles, allowing a light spray of GPC to dwell on the surfaces of the microwave will soften the particles for later removal. Next, a microfiber cloth dampened with GPC may be used to remove any loose food particles/soil on the inside and outside surfaces of the microwave.

The next daily task 305 of cleaning a breakroom includes damp wiping 393 of appropriate surfaces. First, windows/glass partitions, switch plates and door push plates should be spot cleaned as needed. Next, all tables, chairs, counters, and cabinet fronts should be wiped using GPC as needed. A microfiber cloth may be used. As the cloth becomes soiled, it may be rinsed, wrung and reused as needed. At this point, final cleaning of the microwave may be required.

The next daily task 305 of cleaning a breakroom includes cleaning sink(s) 395. A tile, tub, grout and toilet bowl cleaner, such as RTU Green For™ Restrooms (GFR), may be sprayed into the sink(s). GFR is a non-corrosive cleaner for daily cleaning of restroom fixtures. The diluted solution is applied directly to the surfaces using a bowl mop, sprayer or squirt bottle. The concentrate solution can be applied for the gentle removal of calcium, lime and rust deposits and may be applied weekly or when extremely soiled conditions exist. The diluted solution is also effective in removing soap scum from ceramic tile, showers, tubs and is an excellent grout cleaner. The sink may be cleaned by wiping the sink with a microfiber cloth soaked with GFR or by applying GFR directly to the sink and by wiping with a damp microfiber cloth.

The floors of the breakroom may be spot cleaned 325 on a daily basis using a mop, such as MegaMop™ or FlatMop™, as described above in step 125. Lastly, inspection 330 of the breakroom should be, performed to ensure the desired level of cleanliness and to make sure that all tools and equipment and chairs have been returned to the appropriate location.

The periodic tasks 310 for cleaning the breakroom are optional tasks which may be performed on a daily basis, only if needed. The periodic tasks 310 begin with high/low dusting 335. Upon entering the room, high dust surfaces should be dusted using the cleaning brush apparatus 200. High dust surfaces may include any surface above shoulder height such as, tops of lights, doors, curtain top partitions, ventilation covers, etc. The high/low dusting 335 should proceed around high places of the room until the entryway is reached. Then, dusting should proceed lower towards low dust surfaces, which include surfaces below the waist such as, arms and legs of chairs, tables, etc. The walls may also be spot cleaned as needed. Generally, such intensive dusting is only needed on a weekly basis.

The next periodic task 310 is complete cleaning the floors 345 of the breakroom. The floors of the breakroom may be complete cleaned 345 on a periodic basis using a mop, such as MegaMop™ or FlatMop™, as described above in step 145. The final step of the capture and removal cleaning system 300 for a breakroom is damp cleaning the chair(s) and table(s) 340. Upon entering the room, damp cleaning 340 may proceed to the right and proceeds around the room and back to the point of entry. Microfiber cloth and GPC may be used, just as with the periodic task 110 of damp wiping 140 of the office desks.

Figure 4:
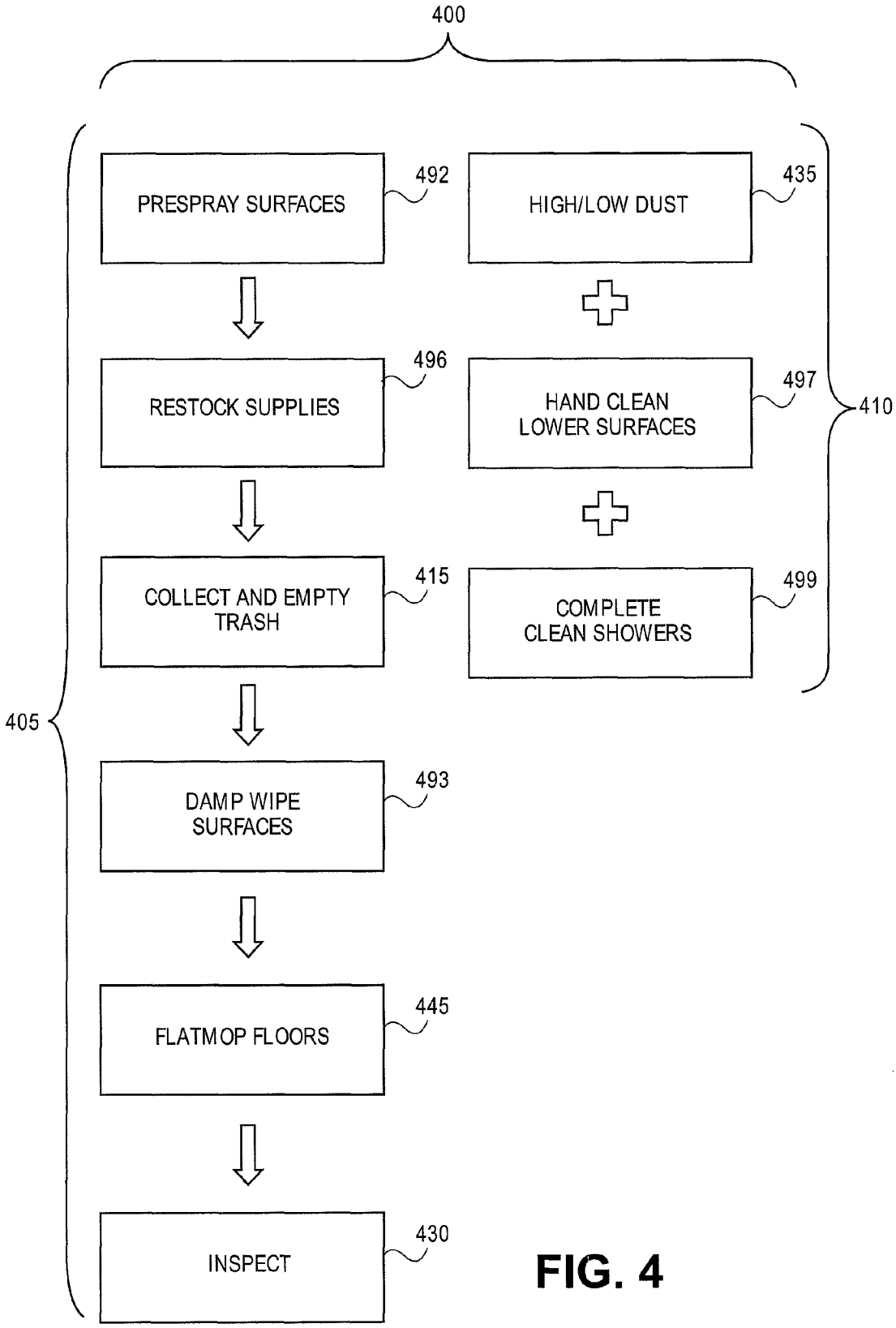
FIG. 4 is a schematic showing of a cleaning system for cleaning a restroom, according to an embodiment of the invention.

FIG. 4 is a schematic showing of a cleaning system 400 for cleaning a restroom, according to an embodiment of the invention. As with cleaning an office and a breakroom, the cleaning system 400 for cleaning a restroom includes both daily tasks 405 and a periodic series 410. The first daily task 405 is pre-spraying all surfaces 492 with GPC, except for the flushables and sinks which are sprayed with GFR. The RTU solutions should be allowed time to soften soil on the surfaces. GFR should be applied to the inside surfaces of urinals and toilets and allowed to dwell for 5-10 minutes so that stains may be later scrubbed off.

The next daily task 405 of cleaning a restroom consists of restocking all supplies 496, which includes restocking paper towels, toilet tissue, facial tissue, vending machine supplies, soap, and refilling any other product dispensers. Then, the restroom trash should be collected and emptied 415, as described in first step 115 in cleaning an office. In the next daily step 405 of cleaning a restroom, microfiber cloth may used to damp wipe all surfaces 493 which may include mirrors, sinks, fixtures, and flushables.

Generally, the surfaces should be cleaned from top to bottom. For instance, the mirror should typically be cleaned before the sink. Cleaning of surfaces 493 should include cleaning inside and behind toilets and behind the rim and down the throat of fixtures using GFR. Toilets should be flushed after cleaning. Regarding use of microfiber cloths, each section may be designated a color cloth, such as, red for restroom, blue for bath and green for general. Such an alliterative system will be easier for the user to remember.

The floors of the restroom may be cleaned 445 on a daily basis using a mop, such as MegaMop™ or FlatMop™, as described above in steps 145 and 345. Lastly, inspection 430 of the restroom should be performed to ensure the desired level of cleanliness and to make sure that all tools and equipment and chairs, etc. have been returned to the appropriate location.

The periodic tasks 410 for cleaning the restroom are optional tasks which may be performed on a daily basis, only if needed. The periodic tasks 410 begin with high/low dusting 435. Upon entering the room, high dust surfaces should be dusted using the cleaning brush apparatus 200. High dust surfaces may include any surface above shoulder height such as, tops of lights, doors, top partitions, ventilation covers, etc. The high/low dusting 435 should proceed around higher places of the room until the entryway is reached. Then, dusting should proceed lower towards low dust surfaces, which include surfaces below the waist such as, sinks and toilet bowl, etc. The walls may also be spot cleaned as needed. Generally, such intensive dusting is only needed on a weekly basis.

The next periodic task 410 is hand cleaning of lower surfaces 497. The lower surfaces of the restroom, such as underneath pipes and corners, may be complete cleaned 497 on a periodic basis using a microfiber cloth or hand mop dampened with GPC. The final step of the capture and removal cleaning system 400 for a restroom is complete cleaning of showers 499. A GFR solution may be applied to the walls and floor of the shower and allowed to remain for 5-10 minutes. The shower may then be agitated with a brush that is as stiff as the surface will allow, taking care not to scratch or scar surface especially with fiberglass units. The shower should then be rinsed thoroughly and inspected.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cleaning method for dusting and cleaning a room, comprising:

daily cleaning tasks including:

collecting and emptying trash into a vehicle for collecting trash, wherein the vehicle includes a container attached to a caster dolly;

spot dusting using a cleaning brush apparatus attached to a vacuum, wherein the cleaning brush apparatus comprises:

a handle having a first end, a second end and a hollow interior;

an outer rail of bristles along an outer portion of the brush having a first row of outer bristles and a second row of outer bristles;

an inner rail of bristles along an inner portion of the brush having a first row of inner bristles and a second row of inner bristles;

at least one row of suction holes located between the first row of outer bristles and the second row of outer bristles to remove materials trapped within the brush;

a first sloped ridge separating a first hole and a second adjacent hole of the first row of suction holes, the sloped ridge having a first curved portion that is adjacent to the first hole and that slopes from an outer portion of the handle toward the hollow interior of the brush at the first hole and a second inwardly curved portion that is adjacent to the second hole and that slopes from the outer portion of the handle toward the hollow interior of the brush at the second hole such that dust is easily suctioned into the holes; and a front row of bristles located along the second end of the handle;

spot cleaning surfaces using a microfiber cloth and a bio-safe general purpose cleaner;

spot cleaning the floors; and inspecting of the room to ensure the desired level of cleanliness and to make sure that all tools and equipment and chairs have been returned to the appropriate location; and periodic cleaning tasks including:

dusting high and low dusting areas using the cleaning brush apparatus;

damp wiping all surfaces of the room using the microfiber cloth and the bio-safe general purpose cleaner; and complete cleaning of the floors.

2. The cleaning method for dusting and cleaning a room of claim 1, wherein the spot cleaning the floors includes vacuuming using a vacuum that is capable of capturing 99.97% of particulates 0.3 microns with a sound decibel level of 70 or less, in accordance with standards set by Leadership in Environmental Design (LEED) Green Building Rating System® guidelines.

3. The cleaning method for dusting and cleaning a room of claim 1, wherein spot cleaning the floors includes mopping using a single step mopping system.

4. The cleaning method for dusting and cleaning a room of claim 3, wherein the single step mopping system includes a push button fluid control valve.

5. The cleaning method for dusting and cleaning a room of claim 4, wherein the push button fluid control valve dispenses a bio-safe neutral pH floor cleanser when activated.

6. The cleaning method for dusting and cleaning a room of claim 1, wherein complete cleaning of the floors includes spraying a general purpose carpet cleaner and stain remover.

7. The cleaning method for dusting and cleaning a room of claim 6, wherein the general purpose carpet cleaner and stain remover are applied with a pressure sprayer.

8. The cleaning method for dusting and cleaning a room of claim 6, wherein the general purpose carpet cleaner and stain remover is designed for use with low moisture systems and does not require extraction.

9. The cleaning method for dusting and cleaning a room of claim 1, wherein the outer and inner rails of bristles of the cleaning brush apparatus are configured to make dirt and soil airborne.

10. The cleaning method for dusting and cleaning a room of claim 1, wherein the at least one row of suction holes of the cleaning brush apparatus includes:

a first row of suction holes located between the first row of outer bristles and the first row of inner bristles;

a second row of suction holes located between the second row of outer bristles and the second row of inner bristles; and a third row of suction holes located between the first and second rows of inner bristles.

11. The cleaning system method for dusting and cleaning a room of claim 10, wherein the suction holes within the first, second and third rows are staggered in relation to each other.

12. The cleaning method for dusting and cleaning a room of claim 1, wherein the front row of bristles of the cleaning brush apparatus includes bristles that angularly protrude from the handle forming an angle other than 90 degrees.

13. The cleaning method for dusting and cleaning a room of claim 1, wherein the cleaning brush apparatus further comprises a plurality of sloped ridges adjacent to each suction hole in the at least one row of suction holes.

14. The cleaning method for dusting and cleaning a room of claim 1, wherein the suction holes of the cleaning brush apparatus that are closer to the first end of the handle are smaller than the suction holes closer to the second end of the handle.

15. The cleaning method for dusting and cleaning a room of claim 1, wherein the periodic tasks are performed weekly.

16. The cleaning method for dusting and cleaning a room of claim 1, wherein the complete cleaning of the floors include completely vacuuming carpets and mopping floors.

17. A cleaning method for dusting and cleaning a breakroom, comprising:

daily cleaning tasks including:

pre-spraying a microwave with a bio-safe general purpose cleaner;

cleaning the microwave using microfiber cloth and the bio-safe general purpose cleaner;

spot cleaning surfaces using a microfiber cloth and the bio-safe general purpose cleaner;

cleaning sinks using a bio-safe non-corrosive cleanser for daily cleaning of restroom fixtures;

spot cleaning the floors; and inspecting of the breakroom to ensure the desired level of cleanliness and to make sure that all tools and equipment and chairs have been returned to the appropriate location; and periodic cleaning tasks including:

dusting high and low dusting areas using a cleaning brush apparatus attached to a vacuum, wherein the cleaning brush apparatus comprises:

a handle having a first end, a second end and a hollow interior;

an outer rail of bristles along an outer portion of the brush having a first row of outer bristles and a second row of outer bristles;

an inner rail of bristles along an inner portion of the brush having a first row of inner bristles and a second row of inner bristles;

at least one row of suction holes located between the first row of outer bristles and the second row of outer bristles to remove materials trapped within the brush;

a first sloped ridge separating a first hole and a second adjacent hole of the first row of suction holes, the sloped ridge having a first curved portion that is adjacent to the first hole and that slopes from an outer portion of the handle toward the hollow interior of the brush at the first hole and a second inwardly curved portion that is adjacent to the second hole and that slopes from the outer portion of the handle toward the hollow interior of the brush at the second hole such that dust is easily suctioned into the holes; and a front row of bristles located along the second end of the handle;

damp cleaning all surfaces of the room using the microfiber cloth and the bio-safe general purpose cleaner; and complete cleaning of the floors.

18. The cleaning method for dusting and cleaning a breakroom of claim 17, wherein the at least one row of suction holes of the cleaning brush apparatus includes:

a first row of suction holes located between the first row of outer bristles and the first row of inner bristles;

a second row of suction holes located between the second row of outer bristles and the second row of inner bristles; and a third row of suction holes located between the first and second rows of inner bristles.

19. The cleaning method for dusting and cleaning a breakroom of claim 18, wherein the suction holes within the first, second and third rows are staggered in relation to each other.

20. A cleaning method for dusting and cleaning a restroom, comprising:

daily cleaning tasks including:

pre-spraying flushables and sinks with a bio-safe non-corrosive cleanser for daily cleaning of restroom fixtures;

pre-spraying other surfaces with a bio-safe general purpose cleaner;

restocking all restroom supplies;

collecting and emptying trash into a vehicle for collecting trash, wherein the vehicle includes a container attached to a caster dolly;

damp wiping upper surfaces, flushables and sinks using a microfiber cloth;

spot cleaning the floors; and inspecting of the restroom to ensure the desired level of cleanliness and to make sure that all tools and equipment have been returned to the appropriate location; and periodic cleaning tasks including:

dusting high and low dusting areas using a cleaning brush apparatus attached to a vacuum, wherein the cleaning brush apparatus comprises:

a handle having a first end, a second end and a hollow interior;

an outer rail of bristles along an outer portion of the brush having a first row of outer bristles and a second row of outer bristles;

an inner rail of bristles along an inner portion of the brush having a first row of inner bristles and a second row of inner bristles;

at least one row of suction holes located between the first row of outer bristles and the second row of outer bristles to remove materials trapped within the brush; and a front row of bristles located along the second end of the handle;

a first sloped ridge separating a first hole and a second adjacent hole of the first row of suction holes, the sloped ridge having a first curved portion that is adjacent to the first hole and that slopes from an outer portion of the handle toward the hollow interior of the brush at the first hole and a second inwardly curved portion that is adjacent to the second hole and that slopes from the outer portion of the handle toward the hollow interior of the brush at the second hole such that dust is easily suctioned into the holes; and damp wiping lower surfaces, including pipes below fixtures, using a microfiber cloth.

21. The cleaning method for dusting and cleaning a restroom of claim 20, further comprising the periodic cleaning tasks:

complete cleaning of a shower using a brush and the bio-safe non-corrosive cleanser.

* * * * *